US006612144B2

(12) United States Patent
Domino

(10) Patent No.: US 6,612,144 B2
(45) Date of Patent: Sep. 2, 2003

(54) DENT REPAIR TOOL AND METHOD

(76) Inventor: Darryl D. Domino, 1724 Manhattan Blvd., Harvey, LA (US) 70058

( * ) Notice: Subject to any disclaimer, the term of this patent is extended or adjusted under 35 U.S.C. 154(b) by 0 days.

(21) Appl. No.: 09/900,836

(22) Filed: Jul. 6, 2001

(65) Prior Publication Data

US 2003/0005745 A1 Jan. 9, 2003

(51) Int. Cl.[7] ..... B21B 1/00
(52) U.S. Cl. ..... 72/67; 72/112; 72/705
(58) Field of Search ..... 72/67, 76, 112, 72/705; 29/90.01

(56) References Cited

U.S. PATENT DOCUMENTS

| | | | | | |
|---|---|---|---|---|---|
| 2,227,949 | A | * | 1/1941 | Toop | 29/90.01 |
| 2,378,871 | A | * | 6/1945 | Stephens | 29/90.01 |
| 3,638,596 | A | * | 2/1972 | Kemp | 72/76 |
| 3,820,210 | A | * | 6/1974 | Kalen | 29/90.01 |
| 4,653,167 | A | * | 3/1987 | Mullins | 72/705 |
| 5,329,802 | A | * | 7/1994 | Nunez | 72/457 |

* cited by examiner

*Primary Examiner*—Ed Tolan
(74) *Attorney, Agent, or Firm*—Michael D. Carbo, P.L.C.; Michael D. Carbo; Ronald J. Ventola, II

(57) ABSTRACT

A dent repair tool has a motor tool having a body and a motor shaft capable of spinning, an elongated inner shaft connected at its proximal end to the motor tool positioned within an elongated outer shaft, and separated from the outer shaft by bushings; and a working head releasably connected to the distal end of the inner shaft. The working head may take any of several forms, including a circular disk having curved protrusions disposed regularly around the perimeter of the disk, an elliptical plate, a triangular plate having rounded vertices and concave sides, and a square plate having rounded corners and concave sides. A system for repairing a dent in sheet metal includes urging the spinning working head of the dent repair tool against a raised portion of dented sheet metal to reduce or eliminate a dent. A method for repairing sheet metal having a dent includes the steps of reducing or eliminating the dent by applying force by means of a rotating perimeter side of a spinning working head to a surface of the sheet metal at the location of raised sheet metal formed by the dent. The method may further include generating a reflection from a front surface of the sheet metal at the location of the dent while the act of reducing or eliminating the dent is being performed, the reflection becoming more ordered as the dent is reduced or eliminated.

9 Claims, 3 Drawing Sheets

DENT REPAIR TOOL AND METHOD

CROSS-REFERENCE TO RELATED APPLICATIONS

Not applicable.

COPYRIGHT STATEMENT

Not applicable.

FEDERAL RESEARCH STATEMENT

Not applicable.

BACKGROUND OF THE INVENTION (1) Field of the Invention

This invention relates to the repair of dents and other deformities in sheet metal, and more particularly to tools and methods which can be effectively used in the art of dent repair, that is, a specialized technique of metalworking that repairs dents, usually without painting, especially dents in the sheet metal surfaces of motor vehicles, and can also be effectively used to repair more extensive automobile body damage.

(2) Description of Related Art

Sheet metal body components of automobiles and other vehicles can become damaged in accidents, by other vehicle doors being opened in parking lots and hitting an adjacent vehicle, by shopping carts rolling into a vehicle, by hail damage from storms, and by many other occurrences. Conventionally, the art of repairing sheet metal damage, including deformities, dents and "dings" (as small dents are sometimes known), has taken several forms. One common technique involves sanding or otherwise abrading the area of the dent or ding to bare the sheet metal and then filling the dent or ding with a filler material such as a substance known commercially as BONDO® (a registered trademark of Dynatron/Bondo Corporation, Atlanta, Ga.), or an equivalent material. The filled area of the dent is then smoothed by grinding, sanding, or rubbing and polishing until the damaged area is level or even with the surrounding sheet metal. The entire area is then repainted to restore its original appearance.

The color, tone and depth of the repainted area rarely matches the original factory paint finish. Even the most artistically applied repair will age or fade differently than the original finish, thus making the repair obvious. Other disadvantages include the need for sandpaper or emery cloth, and the need for surface preparation chemicals, towels and rags, paint and paint applicators.

Other conventional means to remove dents from automobile bodies include the use of a conventional tool known as a slap hammer (also known as a slide hammer) which includes a pointed tip used for engagement with an automobile body panel, such as a fender, usually by screwing it into a hole which has been previously drilled. Thereafter, a weight which is slidable upon a shaft connected to the point is used to hammer the weight outwardly to pull the body panel back into shape. U.S. Pat. No. 4,924,056 teaches a slap hammer which includes a stud welding gun to releasably grip a stud and weld it to the dent and an integral hammer means which applies force to the stud and straightens the dent. U.S. Pat. No. 4,495,791 discloses a pneumatic puller tool having a threaded point, and includes a piston for imparting a driving force against a rear cap by pressure of compressed gas and a spring used to return the piston within the tool. U.S. Pat. No. 4,072,042 discloses a pneumatic puller which includes a universal joint which allows the apparatus to cooperate with a pneumatic wrench. A harness is used to prevent the output shaft from disengagement from the universal joint.

U.S. Pat. No. 5,408,861 discloses a slap hammer which includes an internal drive, and which provides on one end an assembly for engagement with a removable self-tapping member and which provides on the other end a recess adapted for communication with an air wrench drive. The slap hammer disclosed in U.S. Pat. No. 5,408,861 eliminates undue stress on the shaft of the driver, cooperates with a pneumatic wrench, and eliminates the need for a piston. The slap hammer disclosed in U.S. Pat. No. 5,408,861 accepts and cooperates with a drill bit which includes both drill flutes and screw threads. These and other similar prior art dent repair tools require repainting after dent repair.

In the art of so-called paintless dent repair, conventional tools have a working end which can be manipulated by the user to press the damaged area and force the bent metal into alignment with its original surrounding area. However, since most dings occur in the sheet metal of doors, and/or vehicular body portions which are relatively inaccessible, or at least not readily observable with the unaided eye, it is sometimes necessary to provide a pointer which will designate a location of the hidden working end of the tool so that the repair tool can be aligned precisely and exactly on the underside of the ding. Manipulation of the tool to press or tap the sheet metal at an undamaged location could inflict more damage to the sheet metal surface because the gauge thickness of the surface is usually very thin and flexible. U.S. Pat. No. 5,479,804 discloses a tool which utilizes a laser beam instead of a mechanical pointer to designate the exact location of the working end of the tool.

Another paintless dent repair tool includes a working end having a roller bearing on the end of a steel rod. The roller bearing is manipulated by manually moving the steel rod's roller bearing forcefully over the "ding" from the underside of the sheet metal.

One drawback to prior art tools and methods is the slowness involved in paintless dent repair using manual pressing or tapping tools or a manually operated roller bearing. Another drawback is the inability of workers to exert sufficient leverage in some confined or hard to reach places.

BRIEF SUMMARY OF THE INVENTION

The present invention provides a tool for use in repair of dents or dings in sheet metal, particularly sheet metal portions of automobiles. The tool comprises a hand-held, preferably pneumatically-actuated, motor which contains a motor shaft that spins. A preferably elongated inner shaft is connected at its proximal end to the motor shaft, preferably by means of a threaded connection through a collet and a collet chuck, and is connected at its distal end to a working head. The inner shaft is contained within an outer shaft. The outer shaft is connected to the housing of the motor, preferably by means of a threaded collar, to allow a person to grip the motor housing with one hand and the outer shaft with the other hand in order to place the head where needed. Bushings contained within the outer shaft bear and maintain the inner shaft within the outer shaft and still allow the inner shaft to spin as the motor shaft spins. These bushings reduce eccentric movement and vibration of the spinning inner shaft. Preferably, these bushings are constructed from polymer or plastic materials, are shaped to minimize contact with the inner shaft to reduce friction, and are designed to dissipate heat generated by the spinning inner shaft and to allow fluid communication through the bushings.

The inner shaft has a proximal end which is held firmly in the collet chuck by means of a collet threaded onto the motor shaft. A working head having a central annulus is removably connected to the distal end of the inner shaft. Preferably, the working head is connected through the inner shaft to the motor through a seal and bearing on the distal end of the inner shaft or, alternatively, through a grease seal or an oil seal on the distal end. The working head is preferably stainless steel and is shaped so that, when the head spins, curved protrusions on the head can be directed against a raised surface of sheet metal to impact the damaged area and force the bent metal to restore its original alignment with its surrounding area. Since most dents and dings occur in the sheet metal of doors and/or other vehicle body portions which are relatively inaccessible, it is often necessary to have a selection of shaft sizes to allow access and leverage. To allow access within doors of automobiles, the working head can comprise a shaped end of the motor shaft or a shaped head on the inner shaft.

The working head is shaped to allow the rotational motion of the spinning inner shaft to be transmitted as repeated impact force on the raised surface of sheet metal when the head is urged against a raised damaged area of sheet metal. Preferably, the working head is shaped so that when it spins and the perimeter side thereof is urged against the raised sheet metal surface, the head "taps" out the dent or ding. Leverage to force the spinning head against the raised underside of a dent or ding can be obtained either manually or by the use of chains or other supports from which the tool is suspended from the outer shaft.

The present invention is also directed to a method for repair of dented sheet metal using rotational motion of an eccentrically-shaped (i.e., out-of-round) working head, and preferably using a tool according to the invention. The method can include use of conventional pointers, including laser pointers, and conventional means for urging the head against the work piece. Accordingly, it is an object of the present invention to provide a tool and a method for repairing dents in sheet metal.

These and other objects and features of the present invention will become apparent from the following detailed description, wherein reference is made to the figures in the accompanying drawings.

DETAILED DESCRIPTION

Figure 1:
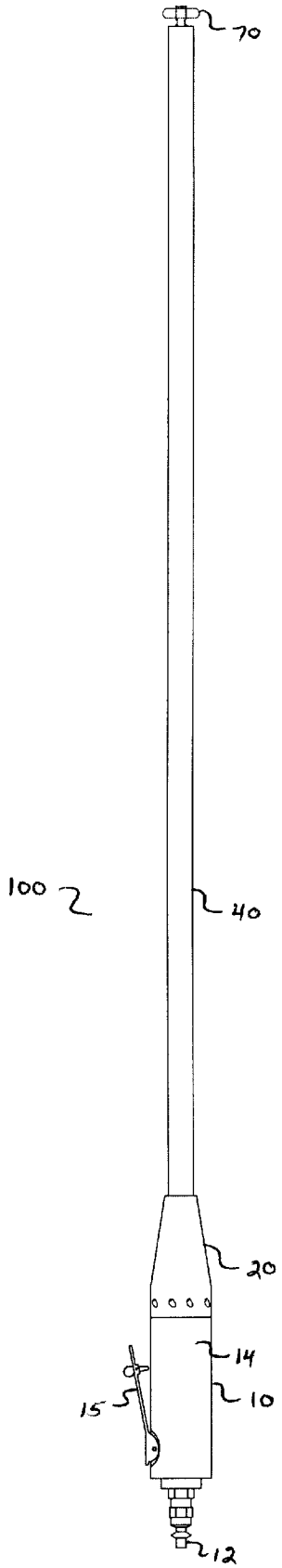
FIG. 1 is a side view of a tool in accordance with an embodiment of the present invention.
Figure 2:
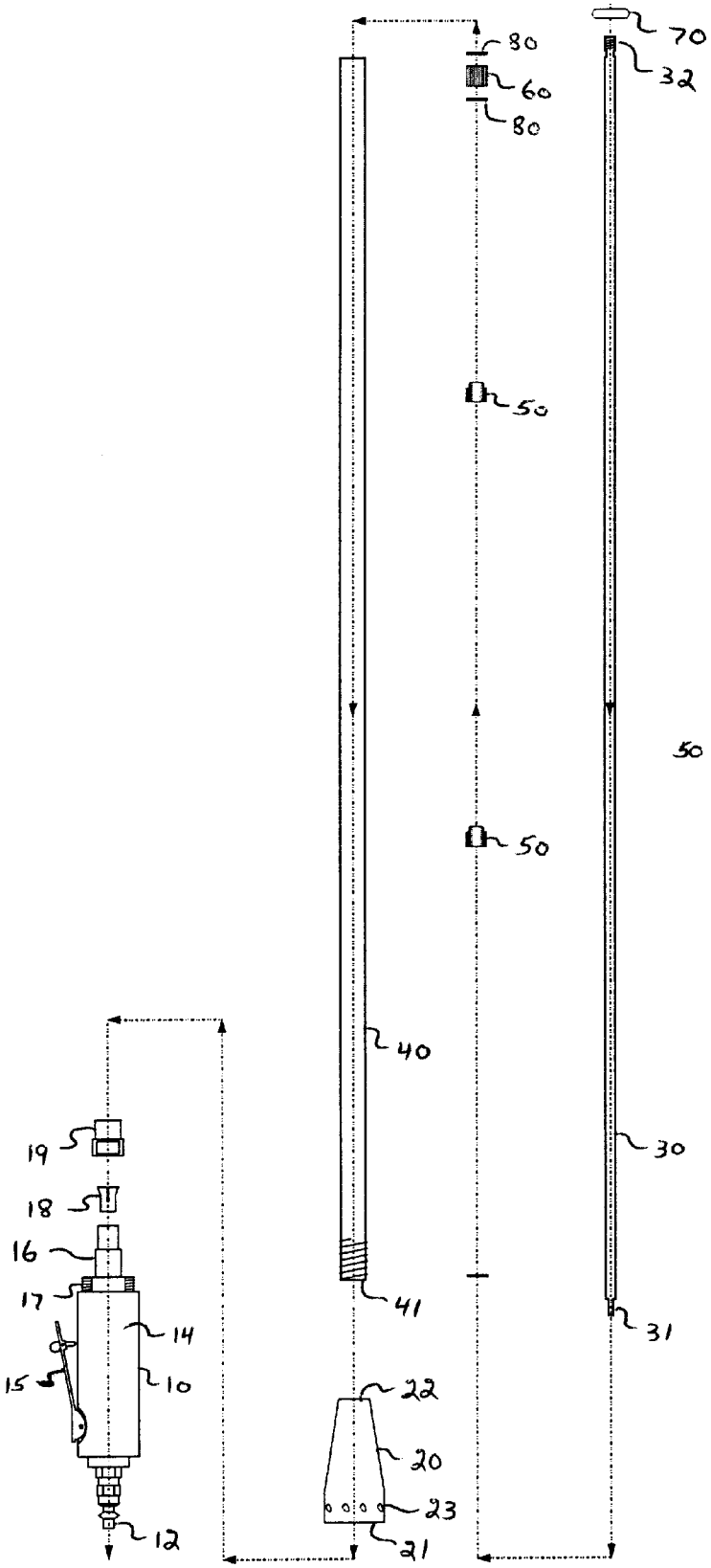
FIG. 2 is an exploded side view of a tool in accordance with an embodiment of the present invention.
Figure 3:
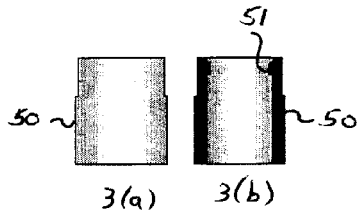
FIGS. 3(*a*) and 3(*b*) depict a side view and a cut-away view of a bushing used in an embodiment of the present invention.

FIGS. 1 and 2 depict a side view of a preferred embodiment of apparatus 100 for reducing or eliminating vehicle damage, including but not limited to dents and dings, in accordance with the present invention. Apparatus 100 includes motor 10, collar 20, inner shaft 30, outer shaft 40, bushings 50, bearings 60, head element 70, and seal 80.

As shown in FIGS. 1 and 2, motor 10 is preferably a pneumatic motor with pneumatic connection 12 adapted for connection to a compressed air or other gas supply (not shown), motor housing 14, actuator 15, motor shaft 16, threaded coupling 17, collet chuck 18, and collet 19. Inner shaft 30, preferably a tempered steel rod, is releasably connected to motor shaft 16 by means of collet chuck 18 and collet 19. Collar 20, preferably frustum-shaped and having interior female threads on both ends, connects at its larger diameter end portion 21 onto threaded end portion 17 of body portion 14, and connects at its smaller diameter end portion 22 to proximal end portion 41 of outer shaft 40. These connections are preferably threaded screw connections. Motor 10 can be a die grinder or drilling tool or, more generally, any air-powered or pneumatic tool. Alternatively, motor 10 can be an electric motor.

Pneumatic motor 10 preferably includes: (i) a housing having a cavity, a supply-air chamber and an exhaust chamber; (ii) a drive assembly; (iii) an air motor disposed in the cavity and coupled to the drive assembly for rotating the drive assembly; (iv) a throttle valve, usually actuated by pressing a thumb-actuated lever, for controlling the operation and speed of the pneumatic motor; (v) a chuck secured to the drive assembly by a collet, which screws into a first end of the drive assembly, for receiving a tool element on the drive assembly; and (vi) flexible, vibration absorbing material attached to the housing.

Inner shaft 30 is an elongated, preferably tempered steel rod having proximal end portion 31 and a distal end portion 32. Inner shaft 30 spins in synchronization with motor shaft 16 of motor 10. Proximal end portion 31 is a reduced diameter segment keyed for insertion through collet chuck 18 into the end of motor shaft 16. Collet 19 holds inner shaft 30 in place on motor shaft 16. When collet 19 is screwed onto motor shaft 16, collet chuck 18 tightens around proximal end portion 31 of inner shaft 30. Distal end portion 32 is adapted to receive head element 70, which contains a central, internally threaded annular space 71, for screwing head element 70 into distal end portion 32.

Outer shaft 40 is an elongated, rigid, preferably stainless steel, tube or pipe or hollow rod, having proximal end portion 41 adapted for connection to the pneumatic motor housing by connecting proximal end portion 41 of the outer shaft 40 to end portion 22 of collar 20 and connecting end portion 21 of collar 20 to motor housing 14 at threaded coupling 17. A rubber or other vibration-reducing grip can be placed on outer shaft 40 for convenience in holding the outer shaft during operation.

Collar 20 is preferably a truncated cone-like shape (i.e., frustum) removably attachable to motor housing 14 at threaded coupling 17. Collar 20 preferably has apertures 23 in its base to reduce air pressure build-up in case air pressure builds within outer shaft 40 during operation. The effect of collar 20 is to stabilize outer shaft 40 during operation. Collar 20 contains inner threads to engage outer threads of the proximal end portion 41 of outer shaft 40. Alternatively, collar 20 can be removably attached to the motor housing.

Contained within outer shaft 40 are bushings 50 and bearing 60 which are annular and are adapted to receive inner shaft 30 to reduce bending of inner shaft 30 during operation and to prevent inner shaft 30 from contacting outer shaft 40 during rotation of inner shaft 30 during operation.

Bushings 50 are preferably Nylatron brand molded plastic/polymeric material (The Polymer Corporation, Reading, Pa.). Friction between bushings 50 and rotating inner shaft 30 generates heat. Each bushing preferably has an interior lip 51 which forms the sole area of contact between inner shaft 30 and bushings 50. Heat developed at the lip transfers by conduction to the remainder of the bushing where it dissipates. Each bushing also preferably has a longitudinal notch on its exterior surface to allow for ease of insertion of the bushing into outer shafts with interior weld beads. A notch can also allow fluid communication between chambers formed within the outer shaft by placement of the bushings along the inner shaft.

Bearing 60 is placed within outer shaft 40 at the distal end of outer shaft 40. Inner shaft 30 is inserted into bearing 60. Grease, oil, or another lubricant can be placed within the outer shaft. Grease or oil seals 80 at distal end 32 of inner shaft 30 prevent escape of any lubricant.

Figure 4:
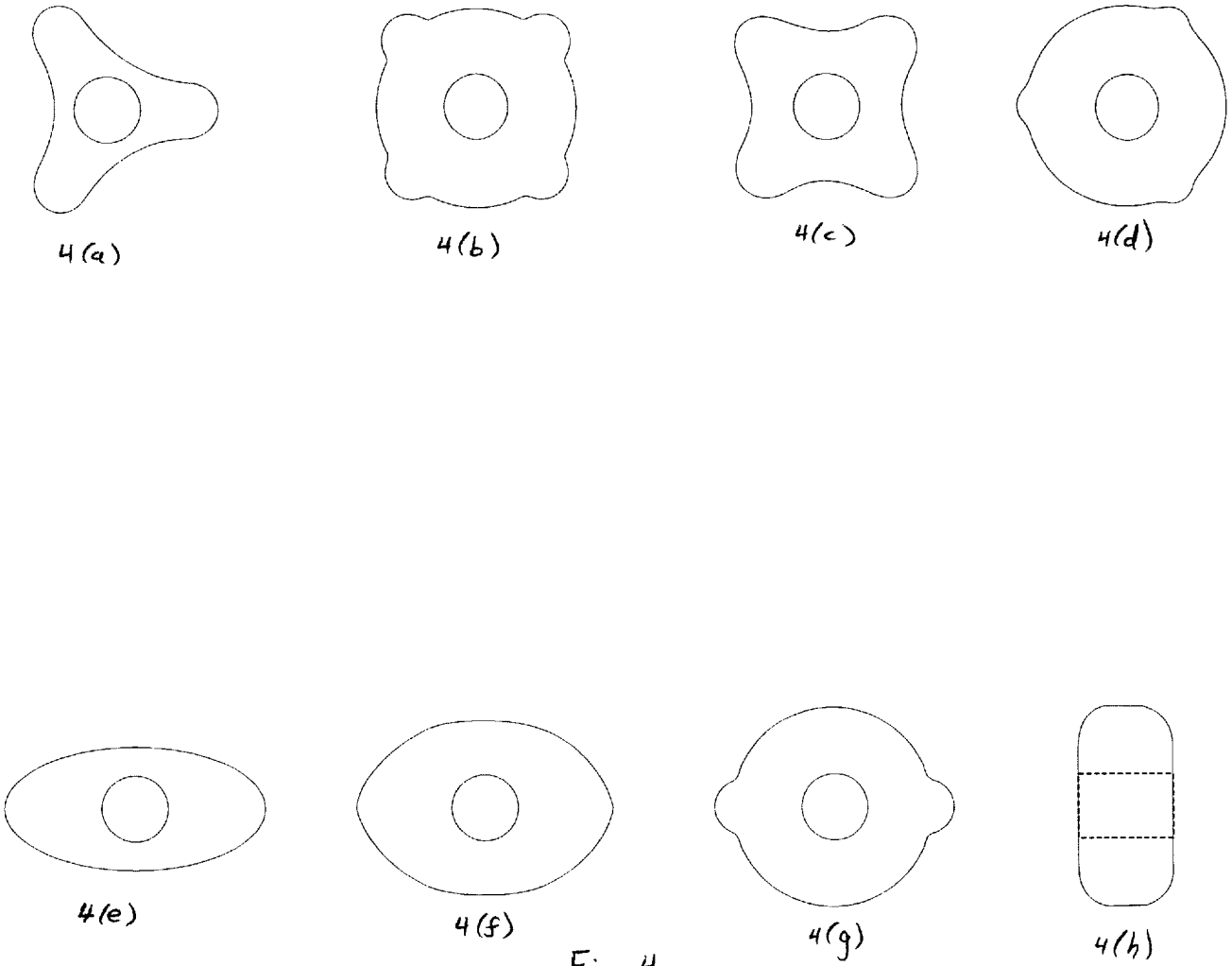
FIGS. 4(*a*) through 4(*h*) depict various embodiments of working heads according to the invention, with FIGS. 4(*a*) through 4(*g*) showing top views and FIG. 4(*h*) showing a side view of a head element.

Head element 70 is removably secured to distal end portion 32 of the inner shaft by means of a threaded central aperture. The head element can be variously shaped to provide rounded or otherwise "smooth" edges so that, in operation, rapid rotation of the head element, when the head element is urged against a raised dent in sheet metal, can provide a tapping force to lower the dent to the plane of the base sheet metal. Various useful shapes are shown in FIG. 4. Preferably, the shape shown in FIG. 4(*b*) achieves optimum results.

Working head 70 is preferably a relatively thin plate, preferably made of stainless steel, and has an eccentric or otherwise out-of-round shape. Many different working head shapes can be used. The central idea is to select the shape of the transverse (i.e., perpendicular to the axis of rotation) cross-section of the head so that, when a spinning head element is urged against a work piece, an "eccentric" portion of the perimeter of the head element strikes a raised portion of dented sheet metal surface. The speed of revolution is such that a normal force urging the head against the sheet metal is insufficient to keep the head continuously in contact with the sheet metal surface, thereby resulting in intermittent contact between the sheet metal and protruding portions of the head element. The raised portion of the dent is thereby "tapped" back into original alignment with surrounding undented sheet metal.

Preferably, the head element is approximately 7/16 inch in thickness and between approximately 1 inch and 1 3/8 inch in breadth. Preferably, the central aperture is approximately 5/16 inch in diameter. Although the head element preferably has at least one longitudinal plane of symmetry, an alternative embodiment dispenses with the head element and uses a transverse protrusion on the distal end portion of the inner shaft or on the drive shaft itself to provide the tapping force to repair a dent.

I claim:

1. A repair tool for repairing a dent in sheet metal, the tool comprising:

a motor tool having a body and further having a motor shaft for spinning an inner shaft;

an inner shaft having a proximal end and a distal end, the proximal end being connected to the motor shaft;

an outer shaft connected to the body of the motor tool, the inner shaft disposed within the outer shaft;

a working head connected to the distal end of the inner shaft; and spacing means for maintaining alignment of the inner shaft within the outer shaft during spinning of the inner shaft.

2. The tool according to claim 1, wherein the working head comprises a circular disk having curved protrusions disposed regularly around the perimeter of the disk.

3. The tool according to claim 2, wherein the circular disk has at least three curved protrusions.

4. The tool according to claim 3, wherein the circular disk has at least four curved protrusions.

5. The tool according to claim 1, wherein the working head comprises an elliptical plate.

6. The tool according to claim 1, wherein the working head comprises a triangular plate having rounded vertices and concave sides.

7. The tool according to claim 1, wherein the working head comprises a square-shaped plate having rounded corners and concave sides.

8. A method for repairing sheet metal having a dent, the method comprising the act of:

reducing or eliminating the dent by applying force, edge of a spinning working head, to a raised surface of the sheet metal at the location of the dent, without the use of an anvil on a back surface of the dent, the force being applied by means of a rotating edge of a working head connected to a distal end of an inner shaft connected to a motor body, the inner shaft being maintained in alignment within the outer shaft by spacing means, and the inner shaft being connected at a proximal end to a spinning motor shaft.

9. A system for repairing a dent in sheet metal, the system comprising:

A system for repairing a raised portion of a dent in sheet metal, the system comprising:

(a) a repair tool comprising (i) a motor tool having a body and further having a motor shaft for spinning an inner shaft;

(ii) an inner shaft having a proximal end and a distal end, the proximal end being connected to the motor shaft;

(iii) an outer shaft connected to the body of the motor tool, the inner shaft disposed within the outer shaft; and (iv) a working head connected to the distal end of the inner shaft, the working head comprising a circular disk having curved protrusions disposed regularly around the perimeter of the disk; and (v) spacing means for maintaining alignment of the inner shaft within the outer shaft during spinning of the inner shaft; and (b) spinning the working head and urging the perimeter of the working head against a raised portion of sheet metal, without the use of an anvil, to reduce or eliminate the dent.

* * * * *